US005115621A

United States Patent [19]

Kobayashi

[11] Patent Number: 5,115,621

[45] Date of Patent: May 26, 1992

[54] FREE ACCESS FLOOR PANEL

[75] Inventor: Tokuzo Kobayashi, Okayama, Japan

[73] Assignee: O M Kiki Co., Ltd., Okayama, Japan

[21] Appl. No.: 696,290

[22] Filed: Apr. 26, 1991

Related U.S. Application Data

[60] Continuation-in-part of Ser. No. 361,137, Jun. 5, 1989, abandoned, which is a division of Ser. No. 95,316, Sep. 10, 1987, Pat. No. 4,856,256.

[51] Int. Cl.[5] ..... E04C 2/34

[52] U.S. Cl. ..... 52/805; 52/792; 52/793; 52/811; 52/630

[58] Field of Search ..... 52/792, 805, 630, 811, 52/126.6, 802

[56] References Cited

U.S. PATENT DOCUMENTS

| | | | |
|---|---|---|---|
| 2,215,918 | 9/1940 | Fay | 52/792 X |
| 3,256,669 | 6/1966 | Seiwert | 52/792 |
| 3,696,578 | 10/1972 | Swensen | 52/792 |
| 3,834,487 | 9/1974 | Hale | 52/792 X |
| 3,938,963 | 2/1976 | Hale | 52/792 X |
| 4,203,268 | 5/1980 | Gladden, Jr. et al. | 52/630 |
| 4,411,121 | 10/1983 | Blacklin et al. | 52/630 X |
| 4,753,058 | 6/1988 | Ray | 52/792 |

FOREIGN PATENT DOCUMENTS

| | | | |
|---|---|---|---|
| 167207 | 5/1980 | Japan | 52/309.9 |
| 842939 | 7/1960 | United Kingdom | 52/805 |

*Primary Examiner*—David A. Scherbel
*Assistant Examiner*—Joanne C. Downs
*Attorney, Agent, or Firm*—Koda and Androlia

[57] ABSTRACT

A free access floor panel including a flat top plate and a bottom plate which are crimped at the upper peripheral edges into a single unit, the bottom plate having an upright wall along the peripheral edges and projected props inside thereof. The top and bottom plates may be made from surface-treated metal sheets so as to prevent damage thereto, and the floor panel thus formed can be filled with porous inorganic materials to upgrade sound proofing.

4 Claims, 6 Drawing Sheets

FREE ACCESS FLOOR PANEL

This is a continuation-in-part of application Ser. No. 361,137, filed Jun. 5, 1989 now abandoned.

BACKGROUND OF THE INVENTION

1. Field of the Invention

The present invention relates to floor panels composing the free access floors of OA (Office Automation) rooms, general business offices, etc. which accommodate various types of equipment, such as office automation devices, computers, etc.

2. Prior Art

Free access floor panels used conventionally include those made of aluminum or aluminum alloys, steel, inorganic materials of concrete system, etc., synthetic resins, and wood.

The free access floor panels are shaped into guadrates, and laid directly on the floor or installed such that they are supported on a specified level by props. The floor thus formed is called a "free access floor", and in many cases, the very heavy equipment, such as computers with peripheral devices, and other OA devices, are installed thereon.

The floor panels for the free access floor made of metals, such as steel, and aluminum alloys include bottom plates having a reinforced construction with uneven surfaces integrated with nearly square top plates. Carpeting made of woven fabrics and unwoven fabrics, or sheets of synthetic resin tiles, etc. are bonded on the upper surfaces of the top plates as finishing materials.

The characteristic features of conventional free access floor panels in terms of the material quality are described as follows:

Conventional floor panels made of aluminum are of merit because they have a high degree of finishing precision, but they also have the following drawbacks. For instance, since the aluminum used for this type of floor panel has a Young's modulus which is about one third that of steel, it is necessary for the aluminum panel to be used in a weight adequate enough to have a Young's modulus similar to that of a steel panel so as to obtain the required strength. This, however, naturally invites increases in cost. Furthermore, since such panels require die casting machine work for its manufacture, productivity is lower in comparison with steel floor panels.

Panels using inorganic materials such as a concrete system, etc. are superior in fire resistance and also low in cost. However, they are generally weak to impact and therefore, are not suitable to be used in a form of a large panel. Besides, since they are heavy, it is difficult to execute construction and layout when using them. Also, it is not desirable to use them in buildings. In addition, they have the disadvantage of creating the dust and easily chipping. Consequently, they are usually covered with steel pans and carpeting materials (for example, U.S. Pat. No. 3,811,237).

Panels made of synthetic resin and wood are advantageous in that they are low in cost and light in weight. However, they are inferior in fire resistance since they easily burn. Also, since they are low in strength, they are laid directly on the floor or used as small panels and thus their use is limited. Therefore, countermeasures must be taken such as covering them with steel sheets so as to improve fire resistance and strength U.S. Pat. No. 4,035,967 and U.S. Pat. No. 4,085,557).

The conventional panels made of steel have advantages in that they are as light weight as aluminum and about one half the weight of concrete system material. They are also high in strength, and have less deflection because the Young's modulus of steel is about three times that of aluminum. However, when the panels are manufactured by be welding as is conventionally done to secure high strength even though they are hollow (for example, U.S. Pat. No. 3,380,217 and U.S. Pat. No. 3,696,578), the welded portions are burnt and oxidized even if the surface treated steel sheets are used for rust prevention, resulting in the formation of rust. Consequently, these panels have the disadvantage in that they need the rust prevention treatments, such as coating after the assembly.

The structural features of conventional free access floor panels will be described below.

Because the floor is formed by laying out identical plates for the entire floor, when there is a difference in the direction and height at the four corners of the free access floor panels, weakness and instability is caused. Therefore, it is necessary to manufacture flat panels with a great degree of accuracy. Also, during installation if the degree of flatness of the underfloor ground is not satisfactory, it will result in floor surface being unsteady. As a result, installation requires a lot of time and labor in order to adjust the unsteadiness. A countermeasure taken against shakiness is to make the panel material into a triangular shape so that shakiness is prevented by forming an aggregate of three-point supporting components. With this countermeasure, even though the panels are virtually square in shape, they are bendable along their diagonal lines, thus solving the foregoing problem (e.g. U.S. Pat. No. 3,852,928).

The inside of a room in which the free access floor is installed needs, for the purpose of maintenance of the equipment therein, a specified temperature be maintained and minimization of noise caused by walking as well as sounds coming from the equipment. The disadvantages of conventional free access floor panels in view of these requirements are as follows.

To achieve sound insulation and thermal insulation to a certain extent, synthetic resin tiles and carpeting materials are bonded to the upper surfaces of the top plates, but such measure are neither sufficient nor positive as a means to solve these problems sufficiently. It has also been attempted to fill the inside of the floor panel with foam concrete as part of the countermeasures, but it is not easy to inject the concrete into the panels. Thus, there has been a problem with its workability. Furthermore, as another attempt, CFRC (carbon fiber-reinforced cement) and GRC (cement reinforced with glass fiber) have been packed inside of the floor panels, but this also has its drawbacks including a high degree of shrinkage/distortion, heavy weight and high cost.

SUMMARY OF THE INVENTION

The free access floor panels of the present invention were obtained after conducting various studies to solve the above described problems, while keeping the advantageous points of the prior art.

It is a first object of the present invention to eliminate the necessity of providing rust preventing treatment to the welded portions of the panels as was required conventionally, even when surface-treated steel sheets are used for the top plates, by assembling without welding.

As a result, the free access floor panels of the present invention have the following characteristics. Firstly, the free access floor panel of the present invention comprises a top plate and a bottom plate which are surface treated steel plates formed into specified shapes by press-forming. The top plate and the bottom plate are integrated into a single unit by crimping (pressure-fastening) their edge areas along almost their entire circumference. Also, with vertical walls formed in either the top plate or the bottom plate, the peripheral (circumferential) surface is formed, and props provided inside of the vertical walls are crimped to either the top plate or the bottom plate at the portions contacting thereto.

When the metal top plates and bottom plates made of surface treated steel panels (sheets) are used for the floor panels with the foregoing structure, since integration of the top and bottom plates is effected by crimping (pressure-fastening), the whole panels do not have portions burnt by welding nor are the exposed portions subjected to corrosion, such as exposed metal portions. Accordingly, surface treated steel sheets can sufficiently maintain corrosion resistance. In addition, the props provided inside of the upright walls, and the truss structure as well as the hollow structure formed by those props, bring about light weight and high strength for the panels, providing a load-withstanding structure.

The next object of this invention is to provide free access floor panels having a structure that prevents unstableness. Such panels are obtained by applying the technique of combining triangular panels as described in the previously quoted U.S. Pat. No. 3,852,928 to the structural design of the steel panels used of this invention. More specifially, either the top plates or the bottom plates are divided along their diagonal lines keeping the advantage of using square form top plates and square form bottom plates to construct quadritic panels which are easy to handle by integrating these plates together.

When such panels are used, even if the ground under the floor is not satisfactorily flat, the panels can be deformed at their divided portions along the diagonal lines, conforming themselves to the contour of the underfloor ground surface. As a result, unstableness is no longer a problem.

Still another object of the present invention is to provide free access floor panels which are light in weight and high in heat insulating performance as well as sound insulation. The panels also improve workability when filling the space between the top plate and the bottom plate with heat insulating material, sound insulating material, etc., while maintaining the advantages of metal floor panels, such as high rigidity and flexibility with respect to processing.

The characteristic feature of the floor panel is that hollow grains of inorganic material or a solidified core (formed products) are packed in the space between top and the bottom plates. In such a floor panel, the hollow grains of inorganic material or the core act to insulate heat and sound, also to protect from fire. In addition, they serve to reinforce the entire floor panel. Therefore, it is possible to make the top and bottom plates thinner, and as a result, even if hollow grains of inorganic material are packed inside, the entire body can be reduced in weight relatively.

In manufacturing, since the inorganic hollow grains have fluidity, they can be packed evenly and easily between the top and bottom plates, without causing distortion. Suitable inorganic hollow grains are those which are hollow inside or those having a large number of closed cells inside. In particular, hollow "shirasu (white sand) balloon" obtained by baking volcanic ash in Kyushu of Japan is preferable. Also, formed products obtained by processing porous inorganic grains, such as pearlite and sepiolite may be used. The artificial ceramic inorganic hollow grains, such as those made into ceramic porous material by mixing swelling resins in ceramics as starting materials which use diatomaceous earth, bentonite, etc., then by treating the mixture with dry-sintering after bringing it into a gelatinous state by adding the swelling agent (Japanese Patent Application Kokai No. 1985-46978); the grains having a porous core at the center portion with dense shells formed along the peripheries (Japanese Patent Application Kokai No. 1986-20646) etc. may be used.

The inorganic hollow grains are packed inside the floor panels as they are, or in a fluid state after being mixed with various types of inorganic or organic binders or they can be formed into a solid body in advance and then placed between the top and bottom plates.

BRIEF DESCRIPTION OF THE DRAWINGS

FIGS. 1 through 3 illustrate free access floor panels, according to the objects of this invention, which are improved to be free of rust even when they are made of steel, in which:

FIG. 1 is a bottom view showing an example of free access floor panels:

FIG. 2 is an enlarged sectional view taken along the line 1—1 in FIG. 1.

FIG. 3 is an end sectional view of the essential portion of another example of free access floor panels;

FIGS. 4 through 9 are diagrams illustrating free access floor panels developed to prevent the possible occurrence of instability and weakness as is case in using triangular floor panels, even though the panels are formed into quadrates, in accordance with another object of the present invention, in which:

FIG. 4 is an enlarged sectional view taken along the line 5—5 in FIG. 4;

FIG. 5 is a plan view of an embodiment showing the surface material is partially broken off;

FIGS. 6 and 7 are enlarged sectional views showing the divided portions, respectively;

FIG. 8 is a perspective view showing an example of bottom plates;

FIG. 9 is a sectional view showing the another embodiment of the free access floor panel, corresponding to FIG. 4;

FIGS. 10 through 14 are diagrams illustrating still another embodiment of the present invention, providing the free access floor panels with excellent heat insulating performance and superior sound insulating performance, in accordance with still another object of this invention, in which:

FIG. 10 is a partially broken bottom view of a free access floor panel;

FIG. 11 is an enlarged sectional view taken along the line 10—10 in FIG. 10;

FIGS. 12 and 13 show another embodiment of this invention, wherein FIG. 12 is a bottom view and FIG. 13 is an enlarged sectional view along the line 12—12 in FIG. 12;

FIG. 14 is a sectional view of an end portion of another embodiment; and

DETAILED DESCRIPTION OF THE INVENTION

Hereunder, a detailed description on the embodiments of this invention will be provided with reference to the accompanying drawings.

Figure 1:
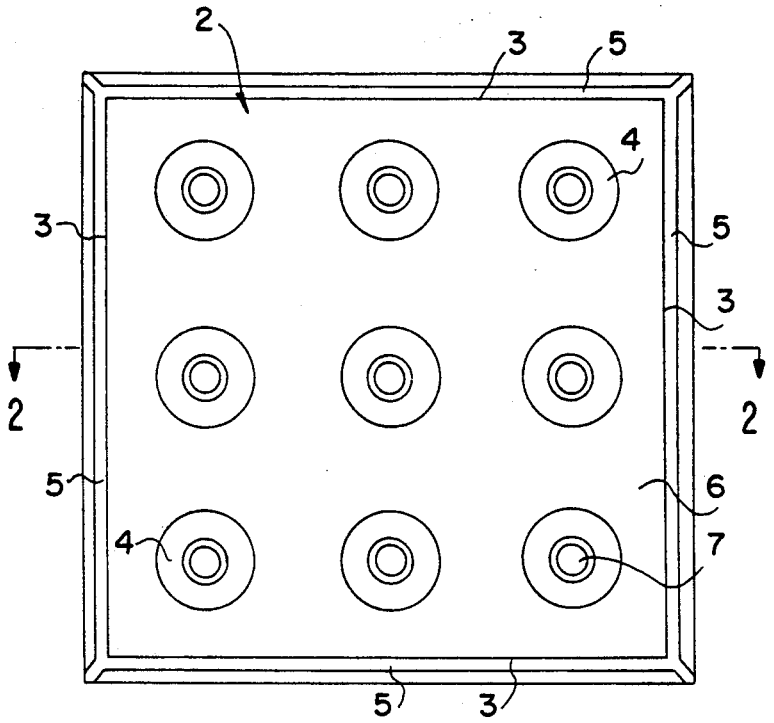
Figure 2:
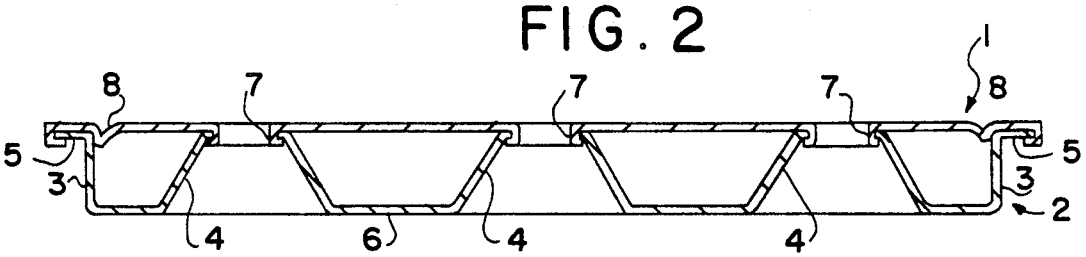
Figure 3:
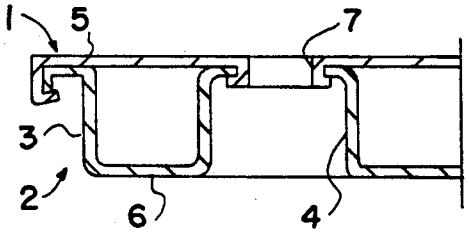

The description of the free access floor panels which are improved to be hardly rusted even though they are made of steel, in accordance with the first object of the invention, will be provided with reference to FIGS. 1 through 3.

As should be apparent from these Figures, the free access floor panel includes a top plate 1 and a bottom plate 2. These plates are steel sheets and their surfaces are galvanized, etc. The bottom plate 2 is provided, along its four sides, with upright walls 3 formed by press-forming. The upper portions of these upright walls 3 are formed into horizontally folded-back (bent) joint flanges 5, and grounding underbodies 6 (the bottom portions coming into contact with the ground) of the bottom plate 2, which are to become the bottom of the floor panel, are provided with props (ribs) 4 formed in a manner to protrude toward the upper side surface. In the top plate 1, engaging holes 7 are disposed at positions corresponding to a plural number of props 4 of the bottom plate 2, and their edges which stick out downward and are then bent to fold are fastened to the upper portions of the props 4 of the truss structure by crimping them. The edges of the top plate 1 along its four sides are bent downward and engage, by crimping, with the joint flanges 5 of the bottom plate 2. At locations on the inner side of the above mentioned edges, pressed grooves 8 are formed, and the backsides of the grooves are in contact with the upper edges of the bottom plate 2.

FIG. 3 shows an example of another crimping structure, and is a longitudinal sectional view of the essential portion. In this example, the peripheral portion of the bottom plate 2 is bent further downward, and the top plate 1 is crimped to the upper portions of the props 4, while also crimping the joint flange 5 of the bottom plate 2, so as to enfold it.

In each example of the free access floor panels of the present invention, the bottom plate 2 is provided with upright walls 3 and props 4, but the invention is not limited to them, and accordingly the steel floor panels may be diversified such that the top plate is provided upright walls and props. Other structures may also be designed within the principles of the present invention.

The free access floor panels having the structures mentioned above make it possible to maintain the amenity in office environment without causing trouble, while those panels are made of steel. These floor panels sufficiently withstand various loads of OA devices, computers and other equipment, and they are light in weight so that changes in the layout of the office can be made optionally. In addition, changes in wiring, etc. in these floor panels can be made easily. Thus, the invention provides a useful free access floor panels for intelligent devices and equipment.

Also in the manufacture, since the panels are made by press working without requiring machining operation, in comparison with those made of aluminum, etc., they can be obtained with higher productivity and at lower cost.

Next, a description will be given on the free access floor panels which are improved to be free of unstableness in accordance with another object of this invention with reference to FIG. 4 through FIG. 9.

Figure 4:
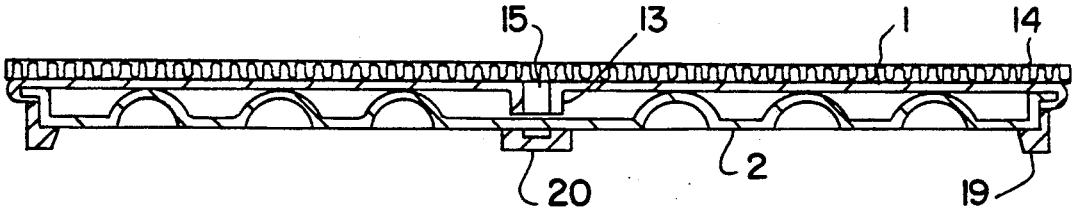
Figure 5:
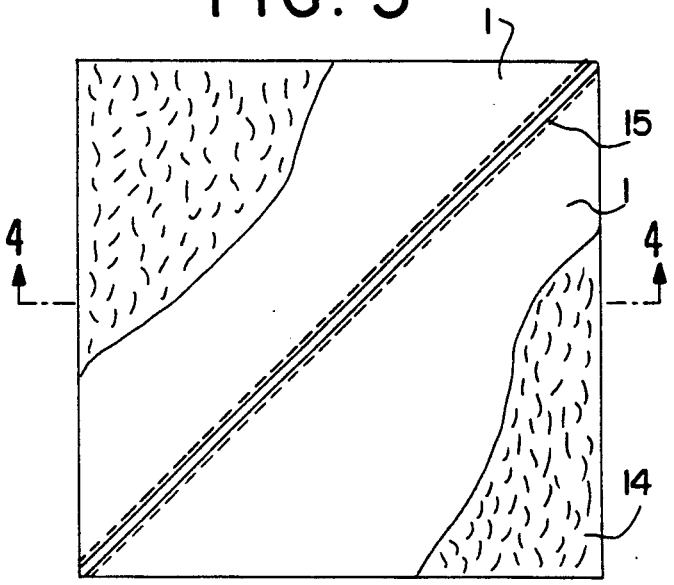

FIG. 4 shows an embodiment of this invention, in the form of an enlarged sectional view taken along the line B—B in FIG. 5, and FIG. 5 is a plan view of an embodiment of the floor panel with its surface covering material partially broken.

In this example, onto the surface of the free access floor panel made of steel and comprised of square form top plate and bottom plate 2, a carpet as the facing material 4 is bonded. The top plate 1 is characteristic in that it is divided into two pieces of nearly triangular plates, along the diagonal line or in the vicinity of it. Then, for each of the two pieces thus obtained, diagonal ribs (ribs provided along diagonal lines) 13 are formed. The division described above may be made in a cross-form in order to obtain four pieces, or part of the corner portions of the top plate may be cut off.

Figure 6:
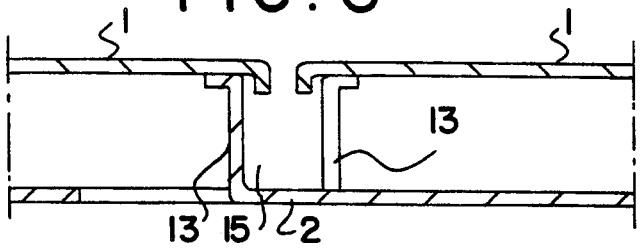
Figure 7:
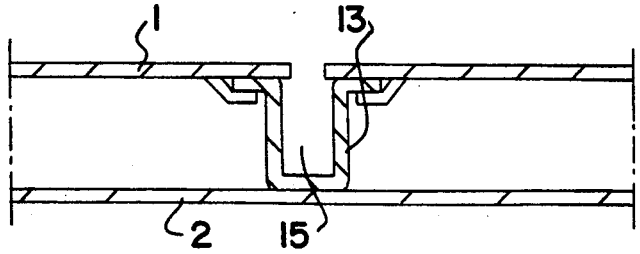

The diagonal ribs 13 may be formed by bending the edges of the divided portions 15 of the top plate 1, or, as shown in FIG. 6, they may be formed by cutting and raising section of the bottom plate 2 then by fixing the raised portions to the undersides of the top plate 1 in a form to be in contact with them. Also, as shown in FIG. 7, as a diagonal rib, a separate member may be fixed.

Figure 8:
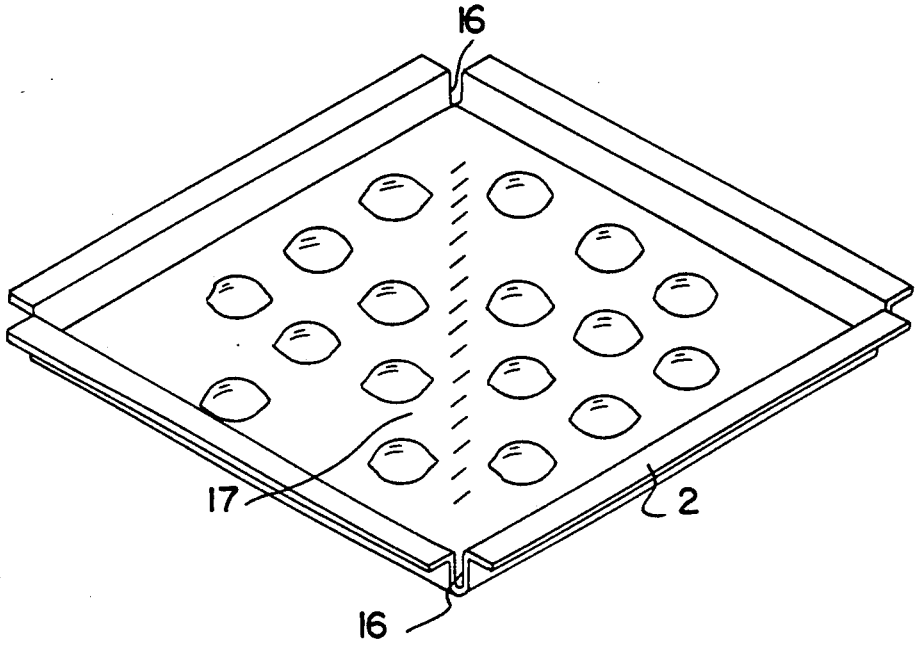

FIG. 8 is a perspective view showing an example of the bottom plate 2 of the free access floor panel as shown in FIG. 4. At the corners of the quadrate, which are located on the dividing line of the top plate 1, slits 16 reaching down to the bottom are formed. The portion 17 corresponding to the divided portion 15 of the top plate 1 forms a flat surface. The portions except for the portion 17 corresponding to the divided portion may take any form. In the Figure, they have a form capable of securing proper depressing strength of the top plate 1 and bending and breaking strength of the whole body of the panel, during the use after completion of the panel by assembling the bottom plate 2 with the top plate 1.

Figure 9:
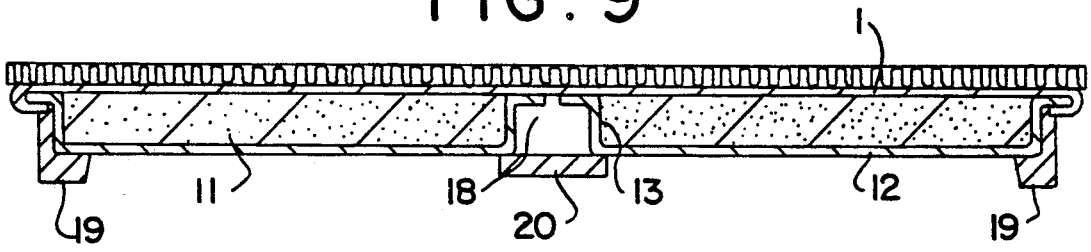

In the examples described above, the top plates 1 are divided, but FIG. 9 shows an example which is the opposite to the above. In the example of FIG. 9, the bottom plate 2 is divided into two. At the divided portion 18 of the bottom plate 2, the diagonal ribs 13 are further bent outward, then fixed to the bottom surface of the top plate 1, and the spaces between the top plate and the bottom plate 2 are filled with padding material. Those used as a pad include light weight foam concrete, foam resin, wood, and honeycomb core. Also in such examples, when the degree of flatness of the ground under the floor is low, the panels can conform to the shape of the ground by deforming themselves at the divided portions 18 along the diagonal lines, thereby not causing the floor to shake or become unstable.

The free access floor panels mentioned above are provided with legs 19 at their four corners. When greater strength is required, auxiliary legs 20 which are a little shorter than the legs 19, are provided at appropriate intervals along the divided portions 15 and 18. The width of the divided portions 15 and 18 is preferably 0.5 mm to several millimeters. When this range is set for the foregoing width, the right angled corners of the finished product of the free access floor can fit to a floor surface which has a level discrepancy of up to about 2 mm in the state of completion of construction work.

In this invention, it goes without saying that a "quadrate" means a square in the orthodox sense, but a rectangle which is different in longitudinal and transverse length, or having a form with corners cut off, are also included in the meaning of "quadrate".

The free access floor panels having the structures described in detail above do not cause shakiness, through absorbing the unflatness in the floor surface, as is the case when using triangular panels, in spite of the fact they are quadrate panels. It is also easier to carry floor panels of the above-described form than it is to carry triangular panels. Also, they can make the setting-out and shakiness adjustment unnecessary. Therefore, installation becomes very simple, and construction costs can be reduced.

In addition to the embodiment referred to in FIG. 9, hereunder a description will be provided of free access floor panels which are improved to have excellent heat insulating performance as well as outstanding sound insulating performance, achieving still another object of this invention through the embodiments with reference to FIGS. 10 through 14.

Figure 10:
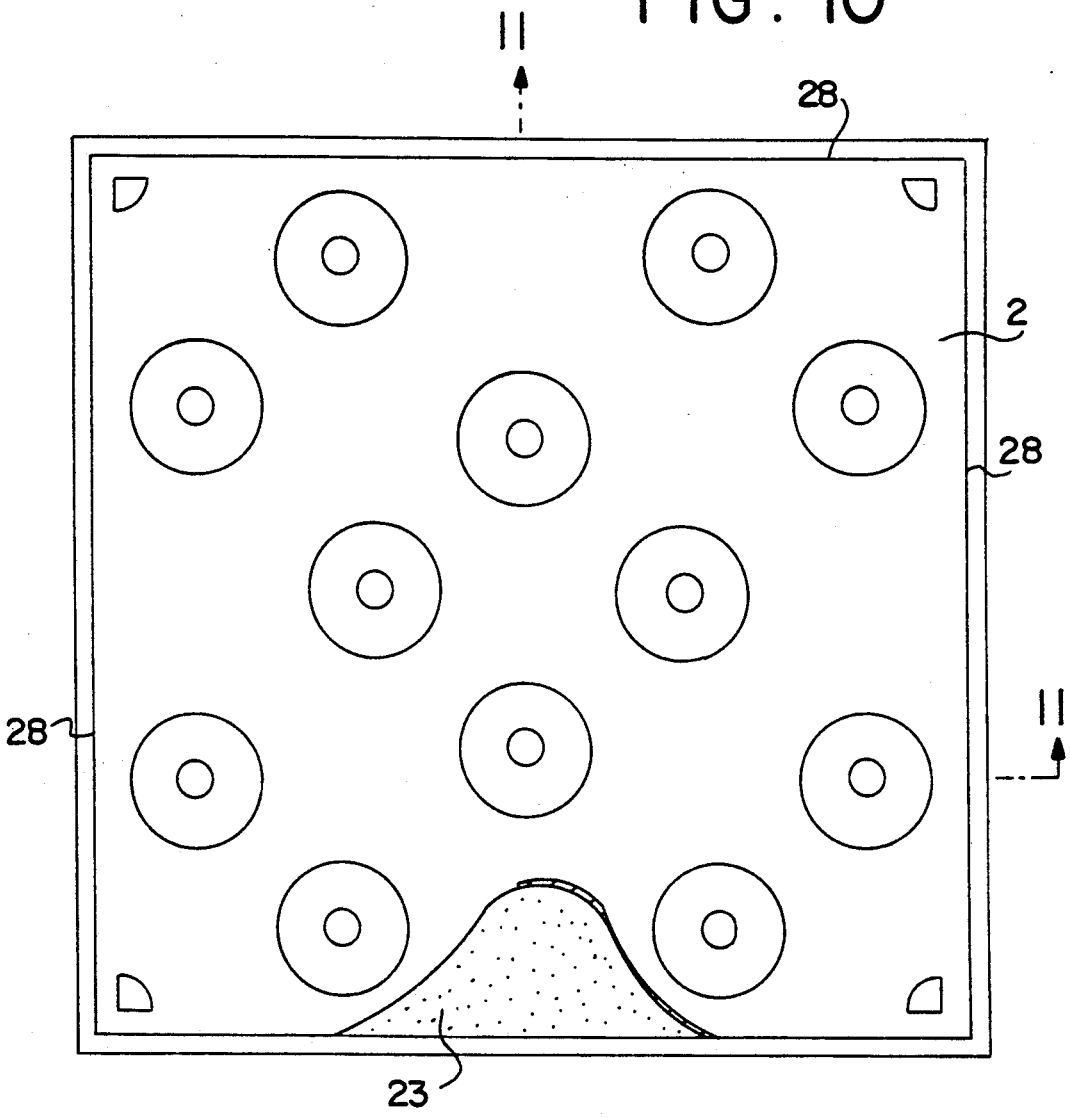
Figure 11:
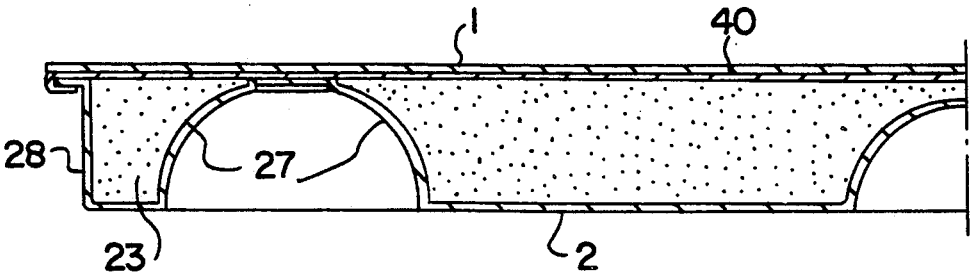

FIG. 10 is a partially broken bottom view of a free access floor panel, and FIG. 11 is an enlarged sectional view taken along the line C—C in FIG. 10.

In this example, both the top plate 1 and the bottom plate 2 are made of steel sheets. When the outer walls 28 on its four side edges and the ribs inside are formed by press-forming, the metal bottom plate 2 becomes integrated with the quadrate and flat top plate 1 by, for example, peripheral crimping. Thereafter, the inorganic hollow grains 23 are injected through an injection hole into the inside space formed by the top plate 1 and the bottom plate 2. Onto the upper surface of the top plate 1, tiles 40 are bonded. The inorganic hollow grains 23 filling the hollow space 27 between the top plate 1 and the steel bottom plate 2 are, in this example, the shirasu balloon of 0.6 to 0.21 mm in grain size (from Aso Cement Co., Ltd. in Japan; brand name Skarlite No. 2). As an example, the grains obtained by mixing this product with cement by arranging such that the volume ratio of shirasu to cement becomes about 3-5 to 1, then by kneading the mixture throughly in a mixer by adding about 50 weight % of water, are poured in and formed. Since they have a very high flowability, they can be applied to the cast-forming method mentioned above.

The cement-mortar filler of the inorganic hollow grains that is formed between the metal top plate 1 and bottom plate 2 is 0.6 to 0.9 in specific gravity in absolute dry condition, and 0.10 to 0.40 Kcal/m.hr.°C. in thermal conductivity as the formed product. This filler product has about two times the strength in both bending and compression, in comparison with foam concrete with the same specific gravity. Also, when glass fiber of about 1 to 20 weight % is added, the strength can be further increased.

Figure 12:
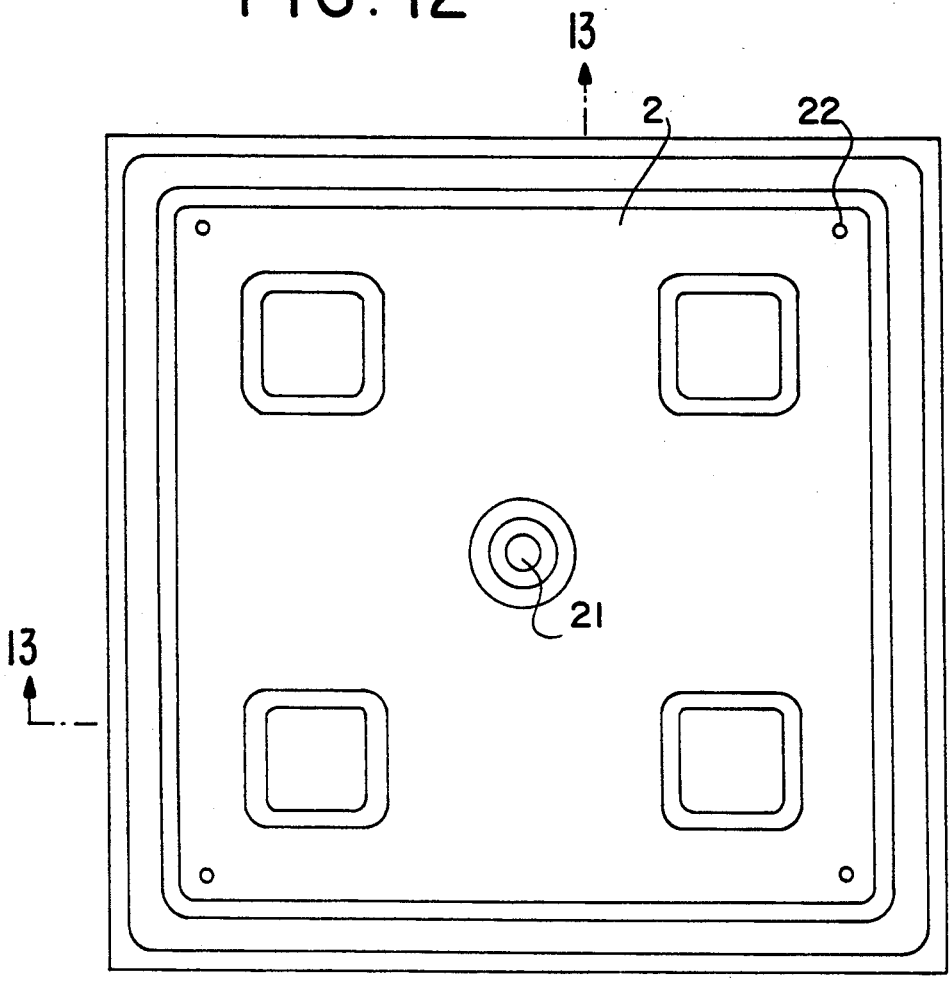
Figure 13:
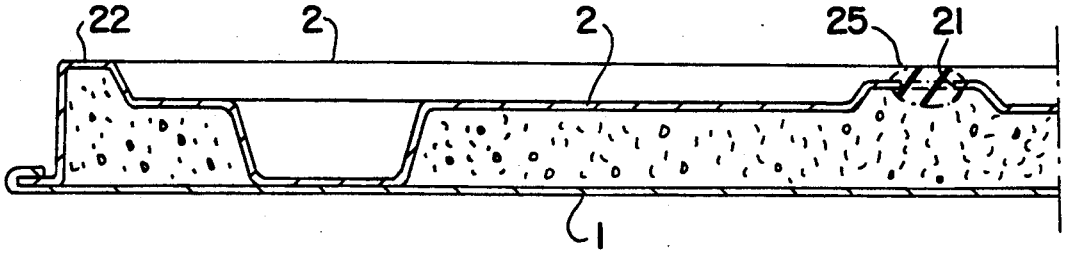

FIGS. 12 and 13 show the other embodiment. FIG. 12 is a bottom view, and FIG. 13 is an enlarged sectional view taken along the line D—D in FIG. 12. In this example, a filler injecting hole 21 is formed at the center of the steel bottom plate 2. The floor panel is mounted on a turntable so that rotation is made with the foregoing injecting hole 21 as the center, and by using centrifugal force, filling can be performed quickly and completely up to the very corners of the filling space formed by the top plate 1 and the bottom plate 2.

The small holes provided at four corners are the dehydration (moisture drying) holes 22. The filler injecting hole 21 at the center is provided with a stepped portion around it for increasing the strength of the bottom plate 2 and also for facilitating fitting a cap 25 after the filling.

The filling of the inorganic hollow grains, etc. into the space inside of the free access floor panel can be effected also to those having other shapes, in addition to the quadrate panels. Besides, other arrangements can be made to the panels of the present invention. The divided portion 15 is formed in the metal top plate 1 by forming the ribs provided along the diagonal line, thereby making it possible for the floor panel to conform to the unevenness of the floor surface. Also, tiles 40 and carpet may be bonded onto the surface of the metal top plate 1 as was practiced conventionally.

As an application of the inorganic hollow grains for the free access floor panels according to this invention, the example of mixing them in cement has been described above. The case to inject the hollow grains before they are solidified, or the case to compact them in either the top plate or the bottom plate and solidify them, then to integrate both the plates have also been mentioned above. However, it is also possible to compact them between the metal top plate 1 and bottom plate 2, after forming and solidifying the grains into specified form.

Figure 14:
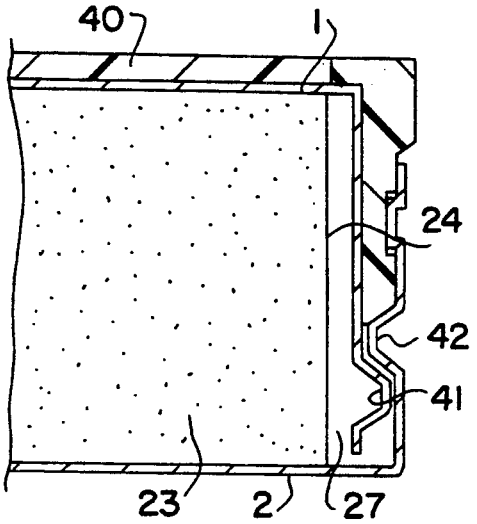

One example is shown in FIG. 14 (a longitudinal section of an end portion of a floor panel). In this example, the side wall of the metal top plate 1 is provided with an external protrusion 41, and this external protrusion 41 engages with an internal protrusion 42 provided on a cup-form outer wall of the bottom plate 2 so that the integration of these top and bottom plates is effected. In the hollow inside space 27 formed by the foregoing metal top plate 1 and metal bottom plate 2, a core 24 is installed during the assembly of the panel. The core 24 is prepared by forming and solidifying the Shirasu balloon inorganic hollow grains 23, the same as that used in the previously mentioned embodiment, together with carbon fibers, using cement.

Figure 15:
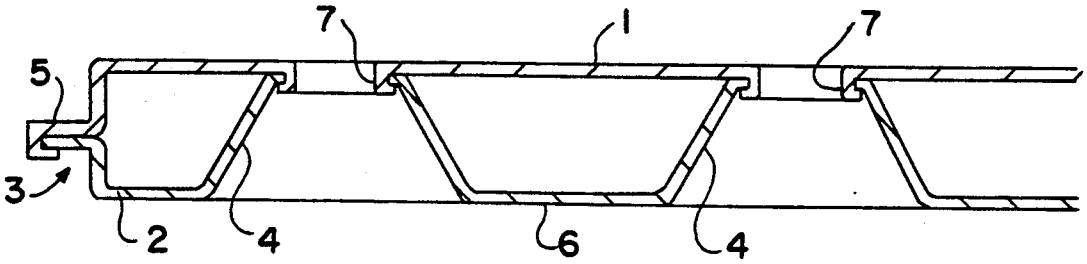
FIG. 15 is an enlarged sectional view of another embodiment of the present invention taken along the line 1—1 in FIG. 1.

Shown in FIG. 15, is another embodiment of the present invention in sectional view along the line 1—1 of FIG. 1. In this embodiment, many elements are the same as that of FIG. 1 except for the construction of the peripheral upright wall. Accordingly, similar elements are given similar referenced numerals. In this embodiment, both the outer peripheral of each of the top plate 1 and bottom plate 2 is bent at substantially a right angle form the upright wall 3 and are joined together by joint flanges 5 which are crimped about the entire periphery.

Thus far, as the medium for forming the inorganic hollow grains 23 into a compact body (core), cement has been referred to as the example. In addition to cement, synthetic resins, such as phenolic resin, or plaster, water glass, etc. may be used.

What have been described above are examples of the embodiments of this invention. The present invention, however, is not limited to those embodiments, and within the latitude in accordance with the specifications necessary for achieving the objects of this invention, the top plate 1, the bottom plate 2, and the inorganic hollow grains 23 may be modified to have structures which have been described above with freedom of choice.

The free access floor panels according to this invention, on which the detailed description has been made, have structures capable of sufficiently meeting the three objects mentioned in the Summary of the Invention. That is, while these panels are made of steel, they hardly become rusty, and also, even when the constructed floor is not finished into a flat plane, the panels absorb discrepancies in flatness thereby providing the floor with stability. Furthermore, during the manufacture, it is easy to fill the inorganic hollow grains between the plates with a high degree of workability, and the cement core installed inside has less shrinkage distortion. The panels are light in weight, remarkably high in heat insulating performance as well as in sound insulating performance, and can withstand a great degree of overloading. In addition, they have a fire resistant structure. Therefore, they are excellent floor materials capable of meeting every requirement for forming free access floors, particularly those used for the rooms accommodating office automation devices, computers, etc.

I claim:

1. A free access floor panel comprising a quadrate top plate and a quadrate bottom plate made of surface treated steel plates, such as galvanized steel, formed into specific forms by pressed-forming, wherein an outer peripheral of said bottom plate is bent as substantially a right angle to form a panel outer peripheral upright wall and an outer peripheral edge along almost an entire periphery, the top and bottom plate are integrated into a single body by only crimping said entire periphery of the top plate and the bottom plate, and a plural number of hollow props are provided in the bottom plate inside of said upright walls and between said top and bottom plates and a plural number of engaging holes corresponding to said plural number of hollow props are provided in said top plate and the top plate portions of said hollow props extend into said engaging holes and said top portions and said engaging holes are crimped together around the edges.

2. A free access floor panel comprising a quadrate top plate and a quadrate bottom plate made of surface treated steel plates, such as galvanized steel, formed into specific forms by pressed-forming, wherein an outer peripheral of said top plate is bent as substantially a right angle to form a panel outer peripheral upright wall and an outer peripheral edge along almost an entire periphery, the top and bottom plate are integrated into a single body by only crimping said entire periphery of the top plate and the bottom plate, and a plural number of hollow props are provided in the bottom plate inside of said upright walls and between said top and bottom plates and a plural number of engaging holes corresponding to said plural number of hollow props are provided in said top plate and the top portions of said hollow props extend into said engaging holes and said top portions and said engaging holes are crimped together around the edges.

3. A free access floor panel comprising a quadrate top plate and a quadrate bottom plate made of surface treated steel plates, such as galvanized steel, formed into specific forms by pressed-forming, wherein an outer peripheral of each of said top plate and bottom plate is bent as substantially a right angle to form a panel outer peripheral upright wall and an outer peripheral edge along almost an entire periphery, the top and bottom plate are integrated into a single body by only crimping said entire periphery of said upright walls, and a plural number of hollow props are provided in the bottom plate inside of said upright walls and between said top and bottom plates and a plural number of engaging holes corresponding to said plural number of hollow props are provided in said top plate and the top portions of said hollow props extend into said engaging holes and said top portions and said engaging holes are crimped together around the edges.

4. A free access floor panel according to claim 1, 2 or 3, wherein filling is filled in said hollow props which is obtained by crimping said top plate and bottom plate.

* * * * *